US005167726A

United States Patent [19]

LoIacono et al.

[11] Patent Number: 5,167,726

[45] Date of Patent: Dec. 1, 1992

[54] MACHINABLE LEAD-FREE WROUGHT COPPER-CONTAINING ALLOYS

[75] Inventors: Dominic N. LoIacono, Franklin Lakes; John T. Plewes, Chatham, both of N.J.

[73] Assignee: AT&T Bell Laboratories, Murray Hill, N.J.

[21] Appl. No.: 523,774

[22] Filed: May 15, 1990

[51] Int. Cl.[5] ..... C22C 9/00

[52] U.S. Cl. ..... 148/432; 148/684; 148/434; 420/472; 420/499; 72/256

[58] Field of Search ..... 148/432, 433, 434, 435, 148/436, 11.5 C; 420/472, 499

[56] References Cited

U.S. PATENT DOCUMENTS

| | | | |
|---|---|---|---|
| 2,804,408 | 8/1957 | Gregory | 148/11.5 C |
| 3,450,573 | 6/1969 | Knapton et al. | 148/11.5 C |
| 4,511,410 | 4/1985 | Shapiro et al. | 148/11.5 C |

FOREIGN PATENT DOCUMENTS

| | | | |
|---|---|---|---|
| 54-135618 | 10/1979 | Japan . | |
| 153723 | 12/1979 | Japan | 148/11.5 C |
| 0581903 | 10/1946 | United Kingdom . | |
| 1157652 | 7/1969 | United Kingdom . | |
| 2211206 | 6/1989 | United Kingdom . | |
| 2211206A | 6/1989 | United Kingdom . | |

OTHER PUBLICATIONS

"Bureau of Mines Circular 9033", p. 6 (1985).

D. W. Davis, "Metals Technology", pp. 272–284 (1976).

"American Society for Metals Handbook on Machining", vol. 16, p. 806 (1989).

R. G. Lee, "Journal American Water Works Assoc.", p. 51 (Jul. 1989).

A. Butts, "Copper", p. 704 (1954).

"ASM Metals Handbook", pp. 907, 916 (1948).

Metals Handbook, 9th ed., vol. 2, p. 241, "Mechanical Working of Copper", 1981.

Price, "Bismuth-its effect . . . cold-working . . . Brasses", Meeting of A.I.M.E., Feb. 1942, pp. 136–143.

Voce, "Embrittlement of Deoxidized Copper by Bismuth", Journal of the Institute of Metals, London, 1947, pp. 323, 351.

*Metals Handbook*, 8th Edition, Published by American Society for Metals, vol. 1, pp. 1010–1011.

*Primary Examiner*—Prince Willis, Jr.
*Assistant Examiner*—Thomas Steinberg
*Attorney, Agent, or Firm*—G. S. Indig

[57] ABSTRACT

Lead inclusion in copper-containing wrought alloys is coming into disfavor due to health and environmental considerations. Machinability, as well as retention of workability properties, associated with lead inclusion are assured by bismuth together with a modifying element, phosphorous, indium or tin, with such modifying element minimizes the workability-precluding embrittlement otherwise associated with bismuth. Fabrication of product dependent upon properties of the large variety of lead-containing alloys is so permitted by use of lead-free material.

11 Claims, 3 Drawing Sheets

MACHINABLE LEAD-FREE WROUGHT COPPER-CONTAINING ALLOYS

BACKGROUND OF THE INVENTION

The invention relates to high copper-containing, lead-free alloys which evidence the machinability and cold working characteristics associated with lead-containing "wrought" copper alloys and warm working characteristics as well. A major aspect of the invention concerns expedient manufacturability of product made from such alloys.

Description of the Prior Art

Elemental copper has been a metallurgical staple from ancient times. Recognized attributes have included castability, workability, corrosion resistance, and more recently, thermal and electrical conductivity. Over the centuries, shortcomings of the elemental material have been satisfied by a variety of additions to result in alloys e.g. brasses, bronzes, etc.

A primary shortcoming of elemental copper, and of many alloy compositions as well, entail machinability. It is well-known, that associated with its many excellent properties, copper due to its "gummy" nature, particularly at the friction-induced elevated temperatures encountered during conventional machining, clogs cutting tools and increases power consumption.

It is also well-known that inclusion of any of lead, selenium, tellurium or sulphur is a complete solution to the machinability problem without seriously impairing other associated properties. For a number of reasons—cost, alloy characteristics—lead is by far the preferred inclusion. Global 1989 consumption of lead-containing copper base alloys has been estimated to be in excess of one billion pounds a year.

Recently, health and environmental concerns have focused on lead toxicity. For example, legislation to severely limit the level of lead acceptable in potable water is being introduced in many countries. In August 1988 the U.S. Environmental Protection Agency (USEPA) proposed a rule to regulate lead in drinking water which explicitly limits the use of lead in piping, fittings, etc. See, *Journal American Water Works Association*, R. G. Lee, et al, p. 51 (July 1989). There are other indications which suggest limitations on lead usage in alloys. For example, there have been legislative proposals which would minimize atmospheric lead, as resulting from volatilization due to high temperature processing.

Bismuth, an element next to lead in the periodic table, shares many of the properties of lead, and does impart machinability to copper-containing alloys. See, *Copper*, A. Butts, ed., p. 704 (1954). Very significant, a variety of studies lead to the conclusion that bismuth shares none of the toxicity problems of lead. Consulation with USEPA indicates that bismuth, in amounts likely encountered, is no problem in drinking water, nor in inhalation or ingestion in industry. Bismuth has been found to have no harmful effect on the human nervous system, nor on health in general. In fact, a common indigestion remedy contains bismuth as a major ingredient.

Unfortunately, studies over the years have led universally to the unacceptability of bismuth inclusion in copper and its alloys. See, *ASM Metals Handbook*, pp. 907, 916 (1948) "Bismuth creates brittleness in amounts greater than 0.001%. Tolerance for bismuth under commercial processing is virtually nil." Text and other literature references to the present day address harmful effect of bismuth—e.g. emphasize deleterious effect on workability at levels as low as 0.0004%. See, *Bureau of Mines circular* 9033, p. 6, (1985).

Interest in bismuth has nevertheless persisted with studies often taking the form of third element additions designed to ameliorate harmful effects. See, *Copper*, A. Butts, ed., pp. 415, 416 (1954). At page 415 it is indicated that the tolerance of Cu to Bi is 0.002% for cold working. His statement at p. 416, " . . . it is doubtful whether the above limit could be doubled in practice . . . " [by use of additions] is exemplary of the literature which indicates unavailability of additions sufficient to compensate for bismuth. Bismuth content required for free machinability is at least two orders of magnitude greater.

Probably the most profound advance is reflected by published U.K. patent application GB 2 211 206 A. Compositions described and claimed rely on bismuth as substituted for lead in copper-containing alloys. Alloys specified contain significant amounts of a variety of elements e.g., zinc, tin, and are tolerant of or dependent on a variety of other elements e.g., nickel, iron, antimony, arsenic, and manganese. The relatively complex compositions do accomplish the primary goaldo, to the extent necessary for stated purposes, somewhat ameliorate attendant deleterious effects of bismuth. The primary goal is explicitly in terms of casting alloys. Indeed, results reported are clearly consistent with machinability, and mechanical properties, required for cast copper-containing alloys.

It is indicated that certain of these cast compositions show some degree of working as well-expressed in terms of percent elongation. Some show percent elongation of ~20% although most fracture at significantly lower values. There is little discussion of this matter in the GB application. Values reported are explicitly for very thin specimens—of the order of 6–8 mm—and there is no report of values for thicker specimens. In fact, elongation values for 8 mm specimens are only ~50% of those for 6 mm.

It was of course well known on the 1988 filing date of the UK application that major concern with lead-free material is for the "wrought" copper-containing alloys. The market consists of roughly a 50—50 division between "cast" and "wrought" leaded alloys. Whereas, characteristics reported are quite suitable for many of the uses of cast alloys, measurements reported in no way suggest departure from the generally assumed inadequacy of bismuth-containing "wrought" alloys.

Wrought alloys are designed in contemplation of far greater cold workability than expected of cast alloys. Cold working capability is conveniently expressed in terms of permitted thickness reduction as for example by cold rolling. It is the view of many that cold working capability should permit about 50% thickness reduction from an initial casting of 0.5 or 1.0 inch minimum cross-section dimension, for example, by rolling. (This capability has reference to so-called room temperature operation—even though temperature typically rises well above ambient due to the working itself, the operation is at temperature below that required to result in significant strain relief. In usual terminology this means that the capability of ~50% thickness reduction is achievable between annealing operations so that greater reduction requires anneal-strain relief before further rolling.) Workability required of "cast" alloys is far lower than this value. A conservative line of distinction between the two classes is 25% thickness reduction. The most relevant property ordinarily expected of cast alloys is elongation to fracture with typical values of 5–10% elongation (equivalent to a thickness reduction of the same magnitude).

SUMMARY OF THE INVENTION

The invention depends upon non-leaded, copper-containing alloys which are properly classified as "wrought". Included compositions may be substituted for leaded materials without altering processing conditions—most importantly without constraint on cold rolling or other working. Compositionally, alloys of the invention in their simplest form depend for wrought characteristics only upon bismuth as supplemented by one of three designated third elements. Required concentrations of the third elements, phosphorous, indium, tin are quite small and lubricating qualities resulting in machinability are attained with lower bismuth content—perhaps half that of lead. Accordingly, desired wrought characteristics are attained at reasonable cost. A sufficient number (~50) of representative included compositions have been cold rolled to 50% thickness reduction from cast ingots of one inch or greater thickness to reliably ascribe such characteristics to compositions within the claimed composition range.

Required ingredients are typically: 0.5–2.0 Bi together with 0.1 P a/o 0.25 In a/o 0.5 Sn, remainder copper. Other ingredients are generally those included in corresponding leaded compositions. (All compositions in description and claims are in weight percent.)

The inventive teaching relies on attainment of wrought characteristics, and accordingly, description as well as claims are in terms of processing requiring such characteristics.

DETAILED DESCRIPTION

Test Procedures

Test procedures designed for measuring "wrought" characteristics are described in this section.

Machinability Index

This characteristic is one of the more difficult to measure. See, "Machinability", D. W. Davies, *Metals Technology*, pp. 272–284 (1976). One of the standard techniques which has been used for characterization of machinability entails measuring the power needed to drill a hole of finite diameter and depth under a fixed applied load. Specification results here are for a 9.5 mm diameter by 1 cm deep hole. Tests were performed without lubrication with an applied force of 45 pounds.

Figure 1:
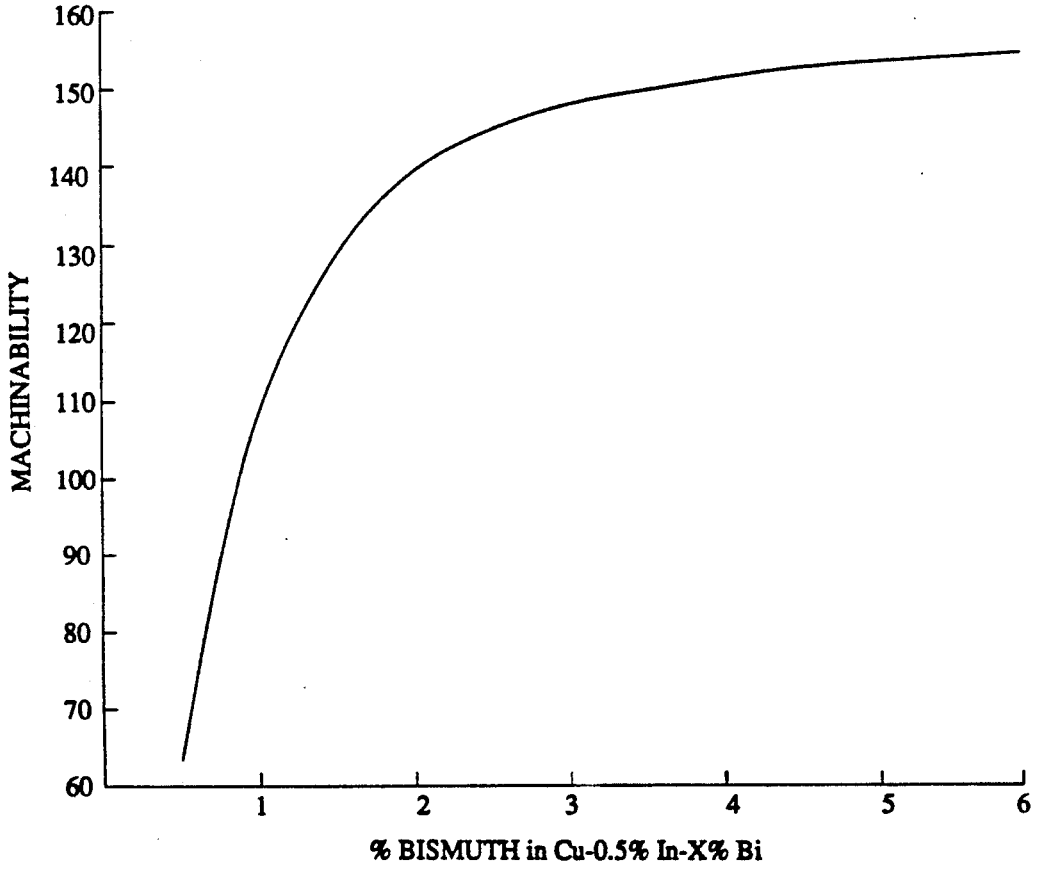
FIG. 1 on coordinates of machinability and weight percent bismuth shows the relationship between these two parameters for illustrative compositions of the invention—for a basic three element material of Cu-0.5% In-Bi with varying Bi.

The Copper Development Association composition series C360 is regarded as the best wrought leaded copper base alloy from the standpoint of free machinability. See, *American Society for Metals Handbook on Machining*, vol. 16, p. 806 (1989). Data presented is comparative, with parallel tests conducted on a series C360 specimen and on bismuth-containing samples in accordance with the invention. Data was normalized against the power consumption required for the C360 alloy. For example, ordinate units on FIG. 1 are in percent with 100% signifying equivalent machinability (the same power consumption) for the bismuth as for the C360 lead-containing composition.

Workability

Qualification of the inventive alloys as "wrought-"—basis upon which the compositional limitations claimed were determined—was based on three distinct procedures carried out in series. Failure of any procedure within the limits specified resulted in an exclusion of the particular composition from the broadest compositional range set forth in the claims. All procedures for each composition were conducted on sections of a twelve inch long cast ingot of minimum cross-section dimension of one inch.

Procedure 1

The ingot was sectioned to a thickness of about 250 mils and samples were cold-rolled in five passes, each reducing thickness by about 25 mils. The test requirement was considered satisfied for samples which were reduced in thickness by 50% (to about 125 mils) without cracking.

Procedure 2

A four inch long section of the casting was lathe-turned to a diameter of 0.625 inch. The resulting billet was hydrostatically extruded at a temperature of 300° to 370° C. to a final bar 0.25 inch in diameter. The test requirement was considered satisfied for samples which exhibited no evidence of surface tearing.

Procedure 3

The extruded bar of procedure 2 was machined to produce a "tensile" bar (in this instance a working section of diameter 0.200 inch diameter, two and one-half inches long within two unmachined, and, therefore, larger, end portions). After annealing, for one hour at 600° C. under nitrogen, the bar was then subjected to tension and the percent elongation to failure was measured with an electronic extensometer of one inch gauge length.

Figure 2:
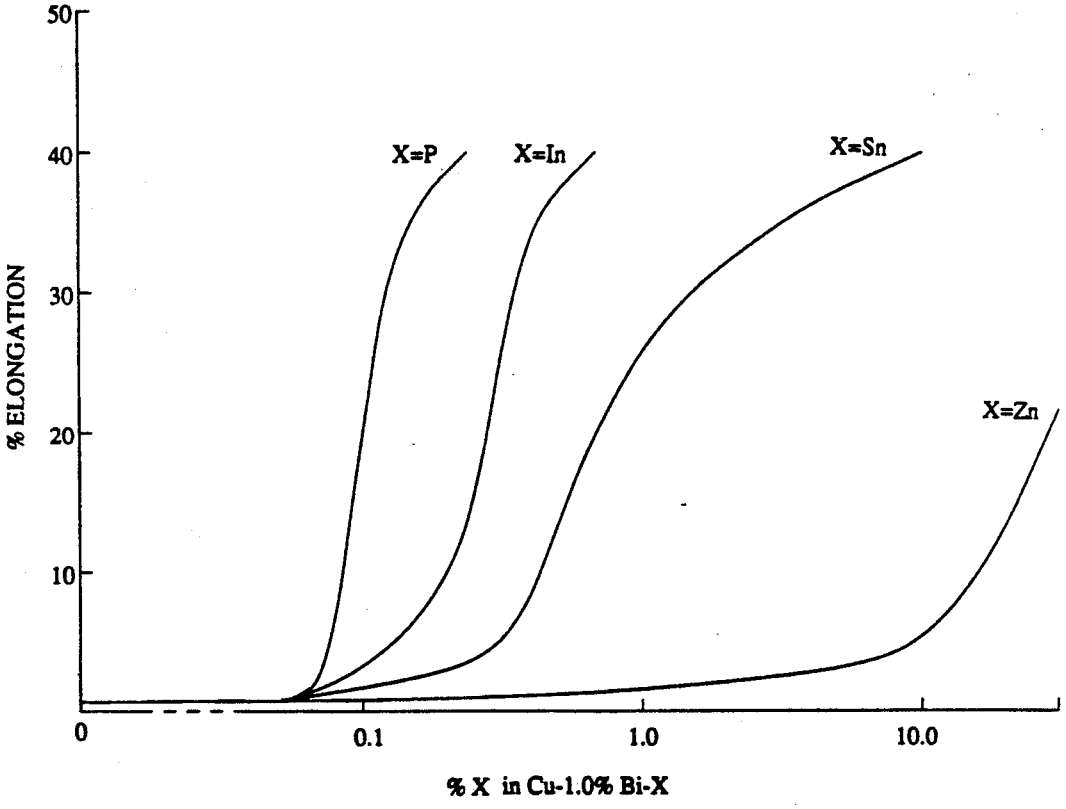
FIG. 2 on coordinates of percent elongation on a linear scale and concentration in log units contains curves showing the relationship of those parameters for a series of compositions based on constant bismuth content but containing varying amounts of effective third element additions together with a reference curve for an ineffective addition.
Figure 3:
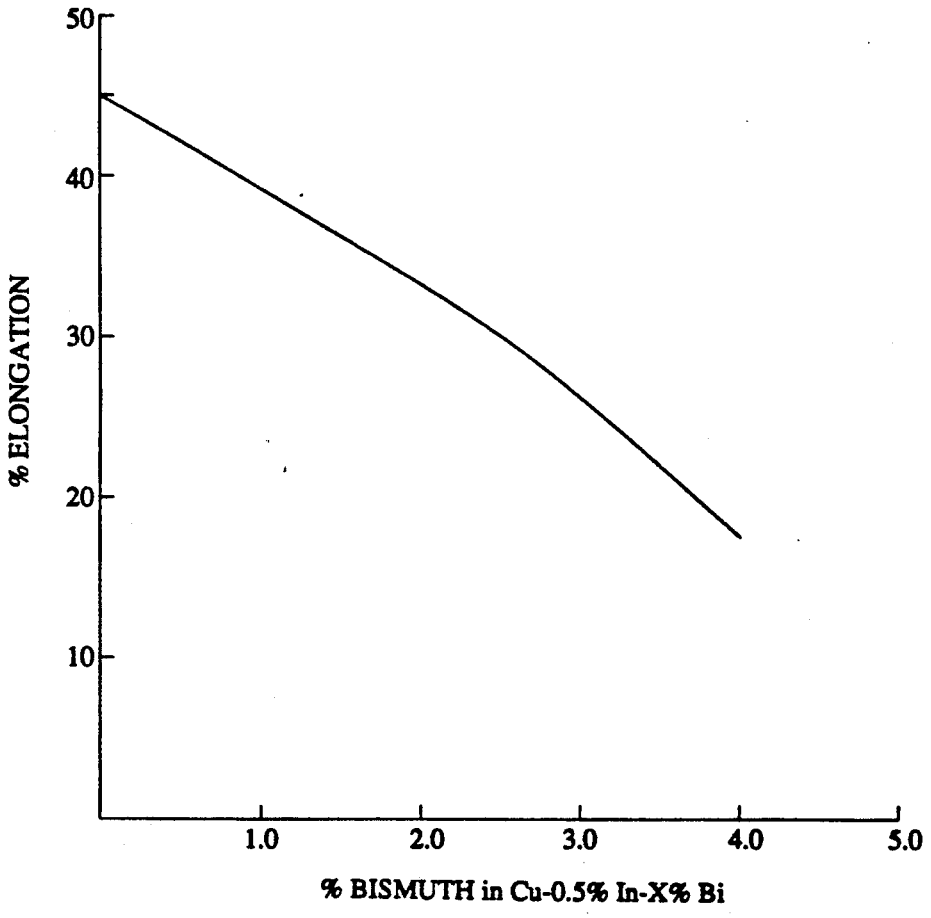
FIG. 3 in ordinate units of percent elongation and abscissa units of bismuth content relates these properties for a representative composition, and taken together with FIG. 1 shows the relationship between workability and machinability for an inventive composition containing a fixed amount of the same third element addition.

Much of the test data determined on the basis of the procedures described is plotted on FIGS. 1, 2 and 3.

The Figures

While initial use of the inventive teaching will likely take the form of direct substitution for lead in existing leaded compositions, it is expected that it will serve a more general purpose. The data of FIGS. 1 thru 3 is largely based on compositions equivalent to leaded compositions—in which Pb is replaced by half as much Bi. The plotted data is also useful in designing new compositions—compositions not having CDA leaded equivalents. Information presented permits alloy design to meet a broad range of fabrication requirements.

For consistency, data presented in the figures is based upon use of indium as the third element addition. Sufficient experiments have been conducted to establish attainment of generally equivalent results by use of either of the alternative elements or in fact by combination of two or three (although as stated, preferential use of phosphorous, or of either or both of phosphorous and indium, is indicated on the basis of end point characteristics. Preference for phosphorous as the sole third element addition is indicated on the basis of economics).

FIG. 1 based on a variable bismuth-containing alloy of copper-0.5 indium shows attainment of 60% machinability at 0.5 bismuth with machinability increasing through 155% at 6.0 bismuth.

FIG. 2 compares the effect of the third element additions on workability in terms of percent elongation. For further comparison, the inadequate effect on workability resulting from incorporation of comparable amounts of zinc in lieu of any of the claimed third element additions is set forth. The base alloy in all instances contains 1.0 bismuth, remainder copper. The starting point for each of the curves is at 0.7–1.0% elongation, the value obtained without third element addition. It is seen that phosphorous and indium are more effective than tin, with phosphorous being the better of the two. Percent elongation rises to approximately 40% with 0.2% P content. Equivalent elongation requires approximately 0.7% indium and 10% tin. Studies conducted on zinc resulted in a maximum elongation of 22.0% for 30.0% inclusion.

FIG. 3 traces the decreasing percent elongation resulting from increasing bismuth content (always for fixed third element addition—other work shows attainment of greater percent elongation for increased third element addition). The data plotted includes elongation of 43% at 0.5% bismuth, dropping to 17.0% at 4.0% bismuth.

Composition

As discussed, compositions suitable for the inventive purposes were determined on the basis of the procedures of a preceding section. In general, compositional ranges define bismuth-containing compositions having machining as well as working characteristics similar to those of the corresponding lead-containing compositions. Most of the experimental work was conducted on fairly simple compositions—those containing primarily bismuth, one or two third element additions, remainder copper. Sufficient additional experiments were conducted to reach the conclusion that the inventive teaching is applicable to the wide range of wrought compositions, e.g. including 5 and 6 element compositions, perhaps one hundred in number, described as CDA copper based alloys. See, *Copper Development Association Standards Handbook on Wrought Products*, Alloy Data/2, 8th ed. (1985), Greenwich, Conn. Wrought compositions are selected on the basis of a large variety of characteristics/cost considerations. Since both machinability and working requirements vary appreciably, compositional ranges are not represented as necessarily yielding specified machinability/working characteristics. Broad compositional ranges of the invention, like the corresponding lead-containing compositions, evidence a machinability of perhaps 40% or greater in accordance with the criterion described (expressed as a percentage of the machinability of CDA series C360 alloy). Comparison with this particular CDA leaded alloy is conventional with the yielded percentage referred to as "machinability index". See, *American Society for Metals Handbook on Machining* cited above. Workability sufficient for intended purposes, also varies, but all compositions on which the claimed range is based exhibited at least 50% thickness reduction upon cold-rolling.

Generic compositions in weight percent are in accordance with the following: Min 0.60 Cu—0.5–2 Bi—0.1–0.5 P a/o 0.25–1 In a/o 0.5–6 Sn with indicated content independent of unspecified ingredients.

A preferred compositional range is based on the observation that smaller amounts of phosphorous and/or indium in that order operate to impart a specified level of ductility (more effectively compensate for embrittlement due to bismuth content as compared with tin).

Another preferred range is based on the observation that bismuth has a larger influence on machinability than does lead. This leads to compositions containing a maximum of 1.5 and even as little as 1.0 bismuth (test results for 1.0 bismuth have yielded machinability of 100% on the basis discussed. Other preferred compositions are responsive to particular needs and are expressed e.g. in terms of greater minimum copper content—65 or 70.

All compositional ranges are in terms of the inventive advance, one aspect of which, simply stated, permits attainment of copper-containing wrought alloy characteristics while replacing lead with a combination of bismuth (generally one-half that of lead) together with one or more of the third element additions. In terms of customary lead-containing alloys, the inventive contribution translates into a large variety of, sometimes discontinuous, compositions which often contain elements designed to serve functions unrelated to the inventive thrust-unrelated to machinability or workability. Prime examples are the phosphor bronzes and the 60Cu/40Zn alpha/beta brasses which may contain e.g. large (35% and more) quantities of zinc. Zinc is illustrative of an element included for imparting other mechanical properties e.g. high yield strength or for reducing cost. In accordance with the generic inventive teaching, leaded wrought alloys containing such additional elements may be rendered lead-free while continuing to serve intended functions with little or no change in processing.

As indicated, a major aspect of the invention is dependent upon bismuth-containing lead-free compositions having characteristics associated with "wrought" alloys—illustratively as set forth in the CDA Handbook. In terms of composition, alloys containing as little as 60% copper with bismuth substituted for lead and containing modifying elements (at least one of P, In, Sn) of specified amounts have been found to share properties of the prototypical lead-containing alloys. Other considerations, e.g. the increased effectiveness of Bi relative to Pb, permit specification of compositions which may have properties superior to the prototypical compositions.

Prototypical lead-containing compositions serve a vast variety of purposes. The many compositional variations are due not solely to desired characteristics, but include other factors, some historic, some economic. The inventive teaching is based primarily on content of copper—most broadly at least 60%—as supplemented by required bismuth—at least 0.5% together with one or more of the modifying elements. (For purposes herein, such compositions—those containing only Cu+Bi+P a/o In a/o Sn—are known as "primary" compositions.) The minimum copper content indicated, is based on the entirety of the final composition without regard to amount and kind of other elements. It might be thought of as the range, e.g. 60%—remainder, since amounts of other primary composition elements ordinarily need not be varied, dependent on inclusion of non-primary elements. CDA designated alloys relevant to the invention—"wrought" alloys—may include one or more of the following elements in the amounts indicated: max 11 Al, max 2 Fe, max 26 Ni, max 2 Co, max 4 Si, max 2 Be, max 3.5 Mn, max 0.08 as remainder Zn. Of course, in common with general practice, no attempt has been made to specify likely inclusion—either minimum or maximum—of unintended ingredients (impurities). Impurity content specification will generally follow established practice for the intended use.

The prior art understanding is clearly in terms of the undesirability of significant Bi content in wrought alloys. The inventive finding is to the effect that inclusion of one or more of the modifying elements as specified totally overcomes this art-recognized prohibition. The inventive advance is most clearly stated in terms of prototypical (lead-containing) wrought compositions which contain little or no content of such modifying elements. Important categories include the high conductivity coppers, brasses, bronzes, silicon bronzes, manganese bronzes, aluminum bronzes, beryllium copper, etc.

In a broader sense, the previously believed prohibition for Bi inclusion applies to prototypical compositions which, in fact, do contain modifying element/s in amount sufficient to assure workability in accordance with the inventive teaching. The direct substitution of Bi for Pb in such compositions accordingly satisfies the need for Pb-free wrought Cu-containing compositions without need for additional modifying element/s. Broad compositional scope, in accordance with the inventive teaching, includes such compositions.

It is useful to describe the alloy categories to which the invention applies. Art-recognized categories, while well-known, are difficult to define with precision. The approach used here is to define categories in terms of members listed in the CDA Wrought Metals Handbook. Categories are listed in usual CDA terminology-sometimes referring to lead content. Alloys of the invention correspond to such CDA alloys but substitute bismuth for lead, tellurium, selenium, or sulphur. Where not already present, required third element (P a/o In a/o Sn or preferred addition/s as noted) is/are added. Such categories are described.

| Category | CDA Series |
|---|---|
| High Conductivity Coppers | 100 |
| Brasses | 200 |
| Leaded Brasses | 300 |
| Tin Brasses | 400 |
| Phosphor Bronzes | 500 |
| Aluminum Bronzes, Silicon Bronzes and Manganese Bronzes | 600 |
| Cupro-Nickel Alloys | 700 |

Processing

The major thrust of the invention is retention of characteristics—importantly retention of processing characteristics of the leaded compositions in compositions now rendered lead-free. This is properly expressed in terms of workability as in alloys which evidence the required amount of machinability. Accordingly, processing in accordance with the invention may be described in terms of fabrication traditionally utilizing leaded copper-containing wrought alloy. Clearly, it is in these terms that the inventive teaching will be construed by the artisan.

It is difficult to specify the range of processing requirements that have given rise to traditional use of the leaded compositions. In general, it may be stated that they entail machinability of a minimum of perhaps 40% (in the terms set forth above) together with cold workability that might be expressed as a thickness reduction of at least 50% (as resulting e.g. from cold rolling). This thickness reduction number is in accordance with expedient commercial processing with such working between anneals in instances in which greater final reduction is required. A lesser reduction, e.g. 25%, is of course permitted but would result in needless increase in expense in the usual instance in which greater ultimate reduction is required. Wrought alloys are ordinarily designed so as to permit 50% reduction (whether actually used or not) and it is in this spirit that the matter is discussed.

Many of the leaded wrought alloys are warm workable (e.g. by extrusion). Fabrication of certain materials such as the wrought brasses make expedient use of this capability. It is an important advantage of the inventive compositions that such capability is retained while eliminating lead. This is unexpected in view of the fact that bismuth embrittlement occurs at elevated temperatures (see for example U.K. Patent Application GB 2 211 206 A as discussed above). It is important that the third element addition in fact compensates for this embrittlement and therefore permits warm working at temperatures e.g. of 300°-370° C. and higher. Warm working is of significance in extrusion which is commonly carried out with application of heat (commonly to extrusion ratios of 5 or greater—this refers to the cross-sectional area ratio of the unextruded and extruded body).

It is interesting to note that the third element addition plays a role in warm working which is independent of considerations relating to strain relief. In fact, the third element may be regarded as permitting the benefits ordinarily associated with strain relief. Reference is made here to the embrittlement mechanism resulting from bismuth incorporation. Embrittlement is the consequence of free surface energies which, without third element addition, results in inter-grain boundary coating by bismuth. This phenomenon does not yield to annealing—in fact, may be aggravated by increased temperature.

EXAMPLES

For comparison purposes, examples, pertaining to machinability and workability for exemplary compositions, are based on samples produced in accordance with a uniform procedure. While the procedure used is commercially acceptable for many purposes, other procedures may be better adapted for particular use depending for example on size and shape of the final article. Such processing conditions are not critical, the primary requirement being essential compositional uniformity.

Sufficient experimentation has established applicability of the inventive teaching to result in lead-free, free-machining alloys to serve in the stead of lead-containing compositions. Experimentation has been extensive—sufficient basis for the terms in which the invention is described. The following examples are selected as representative of each of the categories of alloys to which major commerical activity is directed at this time. While not explicitly stated, the examples reported, consistent with the whole range of experiments on which the teaching is based, refer to compositions which evidence machining/workability characteristics of corresponding lead-containing materials. The product of the following examples evidenced no observed cracking.

SAMPLE PREPARATION FOR ALL EXAMPLES

Oxygen-free high conductivity copper was melted under a controlled atmosphere—under argon at a pressure of 1 atmosphere. When molten, required alloying elements, terminating with bismuth, were added. Bismuth dissolution was essentially immediate at the melt temperature of ~1250° C. (Such "OFHC" copper, standard in the industry, is ~99.99% pure, and while unnecessary for most purposes implicit in this teaching was employed consistent with good experimental procedure. (For commercial purposes, tolerable contaminant levels, are specified in accordance with the intended function.)

The molten alloy was poured into a one inch diameter split steel mold. The castings were air cooled.

EXAMPLE 1

Composition —1.0 Bi—0.15 P—remainder Cu. A cut section of about 250 mil thickness was cold rolled to 50% thickness reduction, annealed at 700° C. for 30 minutes under nitrogen and cold rolling was continued to an additional 75% thickness reduction. (All rolling was multipass with each pass reducing thickness by about 25 mils.) (The 250 mil thick sample was cold rolled to 125 mil, was annealed, and then further cold rolled to 30 mil. A different section of the casting was lathed to 0.625 inch diameter, was heated to 350° C. and hydrostatically extruded to result in 0.25 inch diameter bar. The extruded bar was annealed at 700° C. for one hour and exhibited a tensile elongation value of 34%.

EXAMPLE 2

The cold rolling procedure of example 1 was repeated however with a composition 2 Bi—2 Zn—2 Sn—remainder Cu. Thickness reduction was to 50% in each 5-pass step as separated by anneal.

EXAMPLE 3

The cold rolling and extrusion procedures similar to those of Example 1 were conducted on a sample of composition 2 Bi—0.5 In—remainder Cu. Rolling was to 50% and 75% reduction separated by anneal. Extrusion was unchanged from Example 1. Tensile elongation of the extruded sample was 33.5%.

EXAMPLE 4

The cold rolling and extrusion procedures of Example 1 were repeated using a sample of 1 Bi—0.15 P—10 Zn—remainder Cu. Tensile elongation of the extruded sample was 36%.

EXAMPLE 5

The cold rolling procedure of of Example 2 was repeated on a sample of 2 Bi—4 Sn—remainder Cu.

EXAMPLE 6

A sample of composition Cu—$Sn_{0.5}$ $Bi_1$ was cold rolled in accordance with Example 2 and a second portion was extruded in accordance with procedure of Example 1. The tensile elongation measured was 18.8%.

We claim:

1. Fabrication of an article entailing forming at least a portion from a copper-containing composition having wrought characteristics which in lead-containing composition are associated with lead content, characterized in that such composition is essentially lead free and in which wrought characteristics are substantially due to inclusion of bismuth together with at least one element selected from the group consisting of phosphorus and indium, such composition having a machinability index of at least 40% and having warm workability characteristics to permit extrusion to a ratio of at least 5:1; such extruding at least a fraction of such portion at a temperature of at least 300° C. to an extrusion ratio of at least 5:1; and machining at least a fraction of such portion, in which such composition is essentially of a stoichiometry and content of prototypical lead-containing alloy as specified as CDA 300 series wrought alloys in the eighth edition of the CDA Handbook of Wrought Products except that lead is substantially absent, and in that such composition contains at least 60 copper, at least 0.5 bismuth, together with at least one of a third element in the minimum amount indicated; 0.1 phosphorus, 0.25 indium, with all amounts expressed in wt. %.

2. Fabrication of claim 1, in which such composition contains at least 65 copper.

3. Fabrication of claim 1 in which such composition contains at least 70 copper.

4. Fabrication of claim 1 in which such composition contains phosphorus in the minimum amount indicated.

5. Fabrication of claim 1 in which such composition contains bismuth in the range of from 0.75 to 1.5.

6. Fabrication of claim 1 in which such composition contains bismuth in the range of from 1.0 to 1.25.

7. Fabrication of claim 1 in which such composition contains at least one of the third element additions in the ranges indicated: 0.1—0.5 P, 0.25—1.0 In.

8. Fabrication of claim 1 in which such composition contains at least one of the following elements in the amount indicated: Zn remainder, maximum 11 Al, maximum 2 Fe, maximum 26 Ni, maximum 2 Co, maximum 4 Si, maximum 2 Be, maximum 3.5 Mn, maximum 0.8 As, maximum 6.0 Sn.

9. Fabrication of claim 1 in which fabrication entails cold working at least a fraction of such portion to result in thickness reduction of at least 50% uninterrupted by strain-relief annealing.

10. Fabrication of claim 9 in which such cold working comprises two steps separated by strain-relief annealing.

11. Product produced by the fabrication of any claims 1 through 10.

* * * * *